US006872016B2

(12) United States Patent
Kawaguchi

(10) Patent No.: US 6,872,016 B2
(45) Date of Patent: Mar. 29, 2005

(54) IMPACT DOT PRINT HEAD AND A PRINTER INCLUDING THE SAME

(75) Inventor: Takahiro Kawaguchi, Mishima (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 113 days.

(21) Appl. No.: 10/375,476

(22) Filed: Feb. 28, 2003

(65) Prior Publication Data

US 2004/0170461 A1 Sep. 2, 2004

(51) Int. Cl.[7] ..... B41J 2/305

(52) U.S. Cl. ..... 400/124.11; 400/124.23; 400/124.08; 400/124.17

(58) Field of Search ..... 400/124.01, 124.08, 400/124.09, 124.11, 124.12, 124.14, 124.15, 124.16, 127.17, 124.18, 124.2, 124.23; 101/93.05

(56) References Cited

U.S. PATENT DOCUMENTS 4,812,061 A * 3/1989 Tsuyuki ..... 400/124
4,978,238 A * 12/1990 Sato et al. ..... 400/124
5,056,941 A * 10/1991 Kato et al. ..... 400/124
5,188,467 A * 2/1993 Yamamoto et al. .... 400/124.21
5,527,118 A * 6/1996 Asada et al. ..... 400/124.24
5,600,184 A * 2/1997 Shiga et al. ..... 290/38 R
5,651,621 A * 7/1997 Ishimizu et al. ..... 400/124.21
2003/0175063 A1 * 9/2003 Terao et al. ..... 400/124.01
2004/0042834 A1 * 3/2004 Ichitani et al. ..... 400/124.01

FOREIGN PATENT DOCUMENTS

JP 7-22994 3/1995

* cited by examiner

*Primary Examiner*—Eugene H. Eickholt
(74) *Attorney, Agent, or Firm*—Oblon, Spivak, McClelland, Maier & Neustadt, P.C.

(57) ABSTRACT

In an impact dot print head there is provided a fitting structure for fitting an inner periphery-side cylindrical portion of a yoke and an inner periphery-side ring-shaped portion of an armature spacer with each other so that the inner periphery-side cylindrical portion of the yoke and the inner periphery-side ring-shaped portion of the armature spacer push against each other, thereby permitting a magnetic flux to flow efficiently between the armature spacer and the yoke through the contact face between the inner periphery-side cylindrical portion of the yoke and the inner periphery-side ring-shaped portion of the armature spacer.

10 Claims, 10 Drawing Sheets

IMPACT DOT PRINT HEAD AND A PRINTER INCLUDING THE SAME

BACKGROUND OF THE INVENTION

1. Field of the Invention

The present invention relates to an impact dot print head in a printer and more particularly to an impact dot print head wherein an armature is operated using a magnetic circuit to effect printing, the magnetic circuit being formed by allowing a magnetic flux which is generated by energizing a coil wound round a core provided in a yoke, to flow through an armature spacer, etc., as well as a printer using the impact dot print head.

2. Description of Background Art

Heretofore there has been known an impact dot print head wherein an armature with a printing wire connected thereto is pivoted between a printing position and a standby position, and when the armature is pivoted to the printing position, a tip of the wire is brought into collision with recording paper to effect printing.

In a certain impact dot print head of this type, a magnetic circuit is formed around the armature to be pivoted, the magnetic circuit causing the armature to be attracted from a stand-by position to a printing position with a magnetic flux generated by a coil to effect printing.

For example, the magnetic circuit comprises a yoke having a core with a coil wound thereon to generate a magnetic flux, an armature spacer disposed near an armature at a position in contact with the yoke and not obstructing a pivotal motion of the armature, and the armature which is pivotable between the printing position and the stand-by position. Generally, the yoke is fabricated by forming, while the armature spacer is fabricated by pressing sheet metal. By fabricating the armature spacer by pressing sheet metal it is possible to reduce the armature spacer manufacturing cost.

Although the quality of the yoke fabricated by forming is stable, but that of the armature fabricated by pressing sheet metal is apt to vary.

In the conventional impact dot print head, the yoke and the armature spacer are brought into surface contact with each other, and through the contact surfaces magnetic flux is allowed to flow between the yoke and the armature spacer. However, when there occur variations in the armature quality, it is difficult to maintain a satisfactory state of contact between the armatures and the yoke.

If the state of contact between the armatures and the yoke is unsatisfactory, the magnetic flux flowing efficiency between each armature and the yoke is deteriorated and the attracting force for attracting each armature to the associated core is decreased.

Recently various measures for attaining a high printing speed and a high printing pressure have been taken, but due to the aforesaid decrease of the attractive force which is caused by the generation of leakage flux it is difficult to attain a high printing speed and a high printing pressure to a satisfactory extent.

To avoid such an inconvenience, the armature spacer is subjected to grinding after pressing to ensure a high flatness of its surface of contact with the yoke.

In the conventional printer, however, for maintaining a satisfactory state of contact between the armature spacer fabricating by pressing sheet metal and the yoke, it is necessary to subject the armature spacer to grinding after the pressing work. But the application of this grinding work results in an increase in the number of armature spacer manufacturing steps, and the manufacturing cost increases despite the adoption of the pressing work.

Since the grinding work is performed for each armature spacer, each armature spacer is apt to vary in quality. An attempt to decrease this variation results in a still higher manufacturing cost.

SUMMARY OF THE INVENTION

Accordingly, it is an object of the present invention to let a magnetic flux flow efficiently between an armature spacer and a yoke without complicating a manufacturing process.

It is another object of the present invention to attain the stabilization of quality.

It is a further object of the present invention to reduce the manufacturing cost.

It is a still further object of the present invention to attain a high printing speed and a high printing pressure.

The above objects of the present invention are achieved by novel an impact dot print head and a printer including the same according to the present invention.

In one aspect of the present invention there is provided a fitting structure for fitting an inner periphery-side cylindrical portion of a yoke and an inner periphery-side ring-shaped portion of an armature spacer to ensure a satisfactory state of contact between the inner periphery-side cylindrical portion of the yoke and the inner periphery-side ring-shaped portion of the armature spacer, thereby permitting a magnetic flux to flow efficiently between the armature spacer and the yoke through the contact portion between the inner periphery-side cylindrical portion of the yoke and the inner periphery-side ring-shaped portion of the armature spacer.

In another aspect of the present invention there is provided a fitting structure for fitting an inner periphery-side cylindrical portion of a yoke and an inner periphery-side ring-shaped portion of an armature spacer to ensure a satisfactory state of contact between the inner periphery-side cylindrical portion of the yoke and the inner periphery-side ring-shaped portion of the armature spacer, thereby permitting a magnetic flux to flow efficiently between the armature spacer and the yoke and hence permitting the attainment of a high printing speed and a high printing pressure.

BRIEF DESCRIPTION OF THE DRAWINGS

A more complete understanding of the present invention and of many advantages of the invention will be obtained as the invention is better understood by reference to the following detailed description when the same is considered in connection with the accompanying drawings, in which.

DETAILED DESCRIPTION OF PREFERRED EMBODIMENTS

Figure 1:
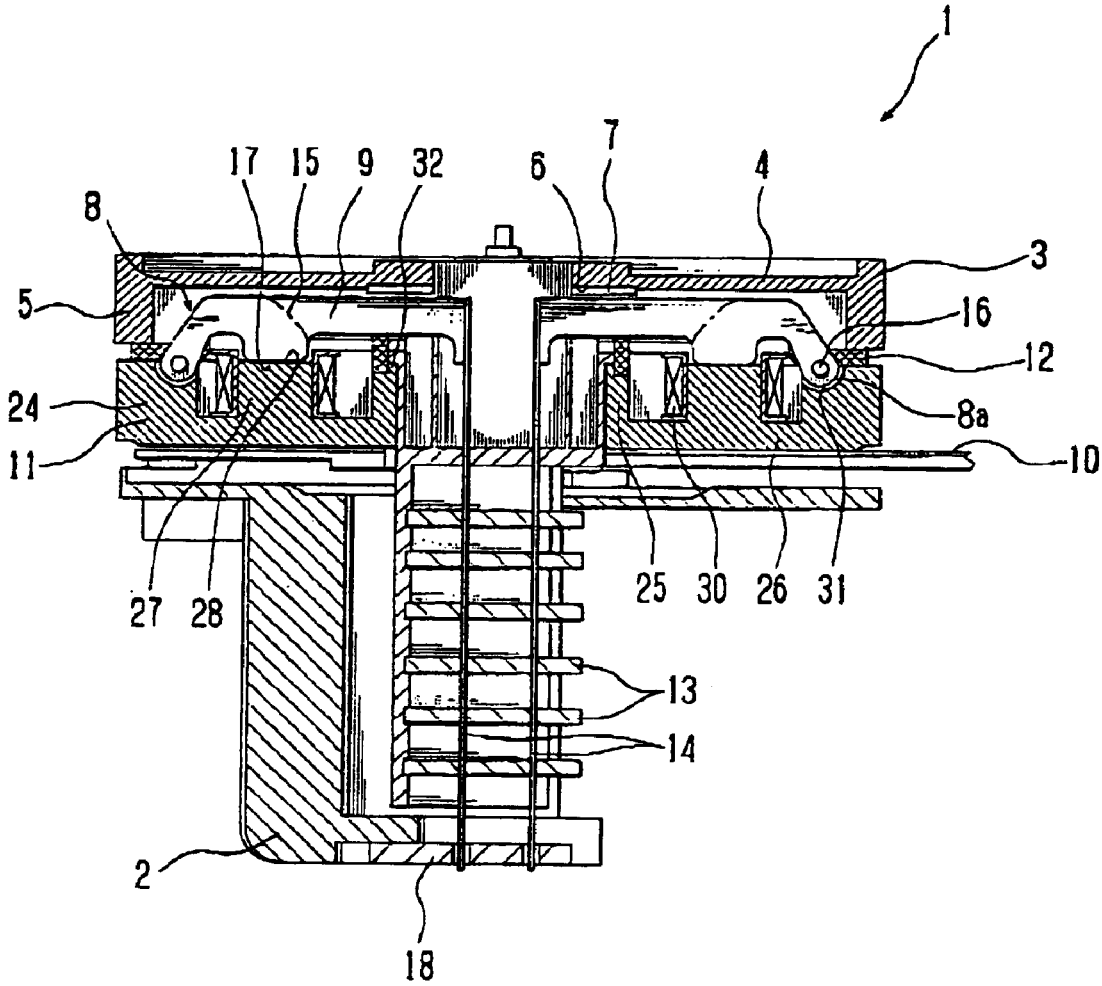
FIG. 1 is a sectional side view showing an entire construction of an impact dot print head according to the present invention.
Figure 2:
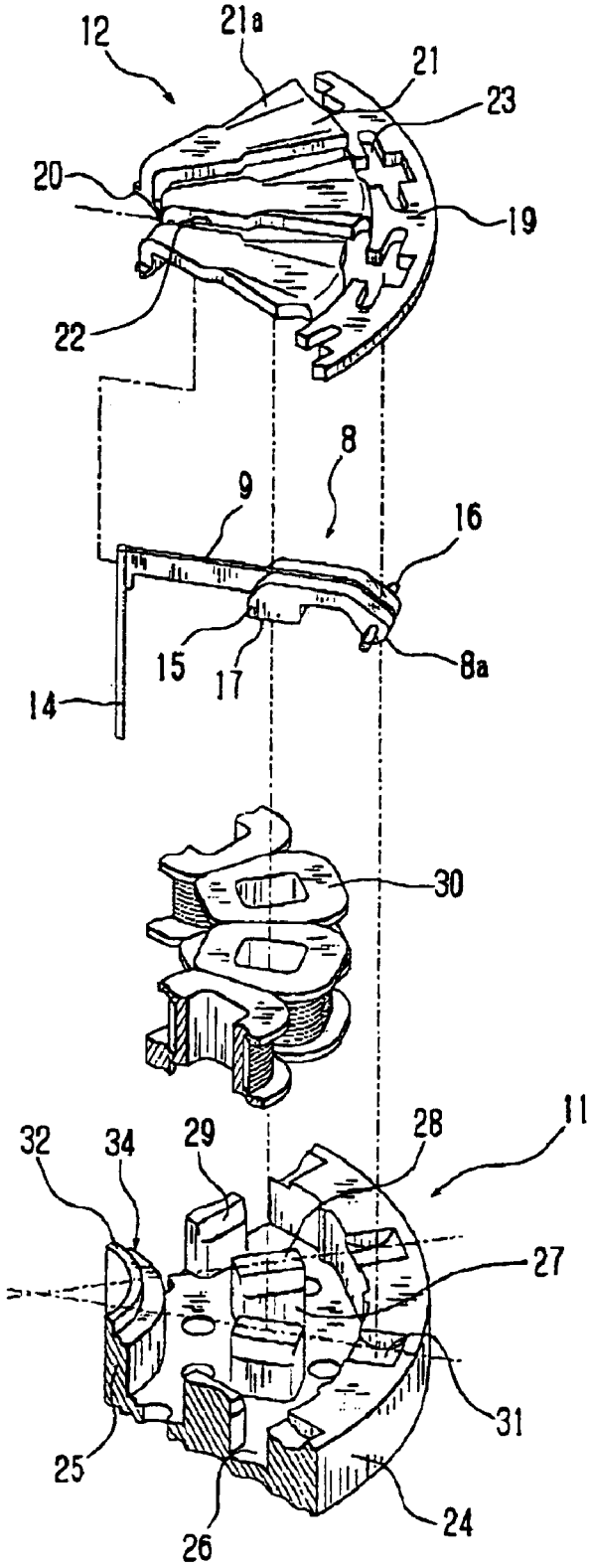
FIG. 2 is an exploded perspective view showing a part of the impact dot print head according to the invention.

An embodiment of the present invention will be described below with reference to FIGS. 1 and 2.

First, a description will be given about an entire construction of an impact dot print head according to the present invention. FIG. 1 is a sectional side view showing an entire construction of an impact dot print head according to the present invention and FIG. 2 is an exploded perspective view showing a part thereof. The impact dot print head, indicated at 1, is provided with a front case 2 and a rear case 3 which are coupled together with mounting screws (not shown).

The rear case 3 has a cylindrical portion 5 which has a bottom 4 on one end side thereof. Centrally of the bottom 4 is formed a mounting recess 7 for mounting therein of a metallic, annular armature stopper 6.

The armature stopper 6 is mounted by being fitted in the mounting recess 7. When an armature 8 to be described later pivots from a printing position to a stand-by position, an arm 9 which is a part of the armature 8 comes into abutment against the armature stopper 6. Thus, the armature stopper 6 possesses a function of defining the stand-by position of the armature 8.

Between the front case 2 and the rear case 3 there are disposed not only armatures 8 but also a circuit board 10, a yoke 11, an armature spacer 12, and wire guides 13.

The circuit board 10 is provided with a circuit for controlling the pivotal motion of each armature 8 between the printing position and the stand-by position. In a printing operation to be described later, any armature 8 can be pivoted selectively by control made by the circuit board 10.

The armatures 8 are each provided with an arm 9, a printing wire 14 (hereinafter referred to simply as "wire") which is soldered to one longitudinal end of the arm 9, magnetic circuit forming members 15 welded respectively to both transverse side faces of the arm, and a pivot shaft 16. Arcuate portion 8*a* is formed on an opposite end side of each armature 8. Plural armatures 8 are arranged radially with respect to the axis of the yoke 11. The armatures 8 are supported by the yoke such that each armature 8 is pivotable about the pivot shaft 16 thereof in a direction away from the yoke 11. With an urging member (not shown), the armatures 8 are each urged in the direction away from the yoke 11.

Each magnetic circuit forming member 15 has a to-be-attracted face 17. The to-be-attracted face 17 is positioned at,a longitudinally central portion of each armature 8 so as to pivot with pivotal motion of the armature.

In the case where the impact dot print head 1 is mounted on a printer 51 (see FIG. 5) which will be described later, and when an armature 8 pivots to the printing position, a tip portion of the associated wire 14 moves with the pivotal motion of the armature up to a position where it strikes against a recording medium such as recording paper.

The wire guides 13 guide the wire 14 slidably so that the wire tip strikes against a predetermined position of the recording medium.

At a position near the tips of wires 14 in the front case 2 there is provided a tip guide 18 for arranging the wire tips in order along a predetermined pattern and for guiding the wires 14 slidably.

Figure 3:
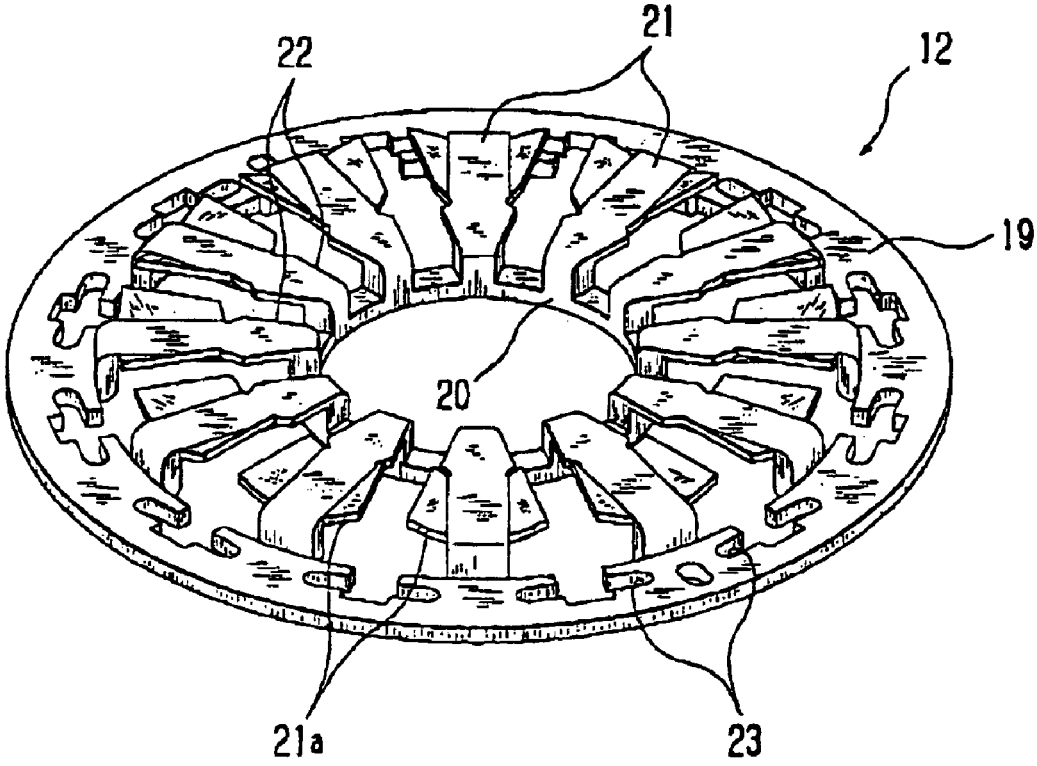
FIG. 3 is a perspective view showing an armature spacer according to the present invention.

A description will now be given of the armature spacer 12 with reference to FIG. 3. FIG. 3 is a perspective view showing the armature spacer 12. As shown in the same figure, the armature spacer 12 has a pair of concentric ring-shaped portions 19 and 20 of different diameters and plural guide portions 21 which span radially between the pair of ring-shaped portions 19 and 20 so as to be each positioned between adjacent armatures 8. The ring-shaped portion 19 located on an outer periphery side, the ring-shaped portion 20 located on an inner periphery side, and the guide portions 21 are integrally formed by molding. Each guide portion 21 is provided with slant faces 21*a* which are each inclined in a direction away from the yoke 11 relative to the surface direction of the armature spacer 12.

Between adjacent guide portions 21 is formed a guide slit 22 which opens in a pivotal plane of the associated armature 8. The guide slits 22 communicate with the outer periphery-side ring-shaped portion 19.

In an outside diameter direction of the outer periphery-side ring-shaped portion 19 are formed bearing slits 23 so as to be open contiguously to each guide slit 22 at both side positions of the guide slit. The pivot shaft 16 of each armature 8 is fitted in the bearing slits 23. The bearing slits 23 fix the pivot shaft 16.

The armature spacer 12 in this embodiment is formed by pressing sheet metal. As to the press working for sheet metal, a drawing and explanation thereof are omitted because it is a known technique, but in fabricating the armature spacer 12 by pressing sheet metal, the sheet metal is subjected to punching in the positions of guide slits 22 and bearing slits 23 and the guide portions 21 are curved in a predetermined shape in the punching direction to form slant faces 21*a*.

Figure 4:
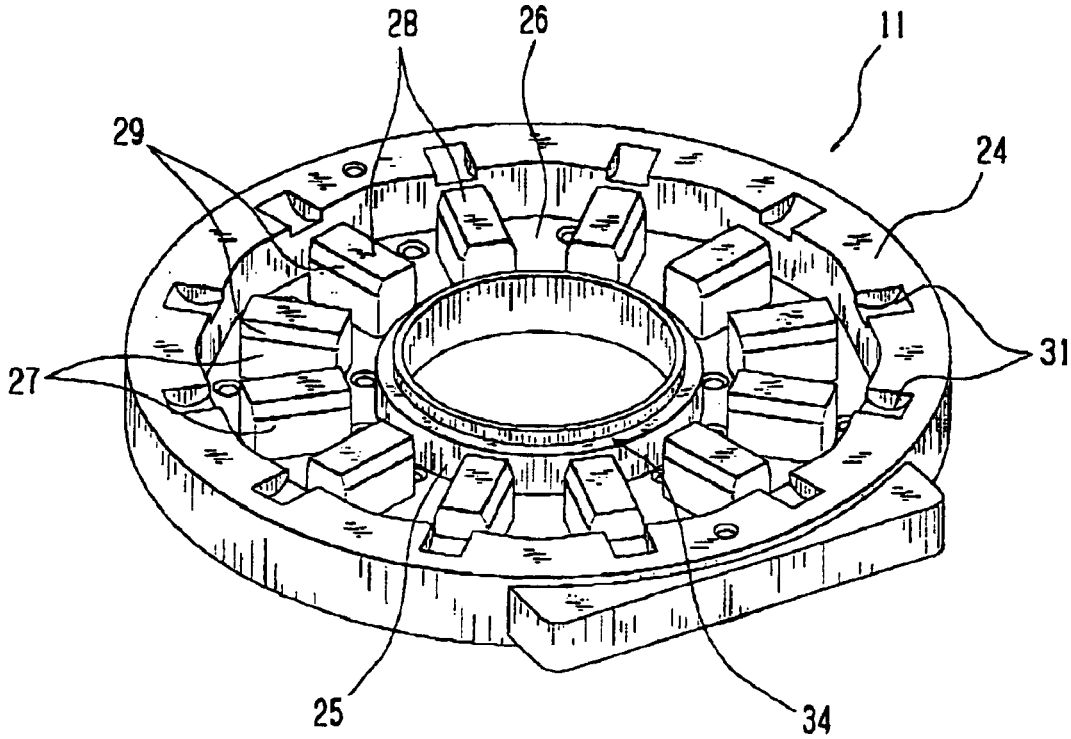
FIG. 4 is a perspective view showing a yoke according to the present invention.

Next, the yoke 11 will be described. FIG. 4 is a perspective view of the yoke 11. The yoke 11 is formed of a magnetic material. As shown in FIG. 4, the yoke 11 has cylindrical portions 24 and 25 on its outer and inner periphery sides, respectively. The outer and inner periphery-side cylindrical portions 24, 25 have approximately the same diameters as those of the pair of ring-shaped portions 19 and 20, respectively, and are concentric with each other. The sizes in an axial direction (the vertical direction of paper in FIG. 1) of the cylindrical portions 24 and 25 are set equal to each other. The direction will hereinafter be regarded as an axial direction of the yoke 11,. The outer and inner periphery-side cylindrical portion 24, 25 are united by a bottom portion 26 which is provided so as to close one end side in the axial direction.

Plural cores 27 are integrally provided on the bottom portion 26 and between the outer and inner periphery-side cylindrical portions 24, 25 so as to be arranged annularly on a circumference concentric with the cylindrical portions 24 and 25. A pole face 2B is formed at one end of each core 27 in the axial direction of the yoke 11. The size of each core 27 in the axial direction of the yoke 11 is set equal to the size of each of the cylindrical portions 24 and 25 in the same direction. The pole faces 28 of the cores 27 are provided so as to be opposed to the to-be-attracted faces 17 of the magnetic circuit forming members 15 in the armatures 8.

On both end sides of each pole face 28 in the radial direction of the yoke 11 are formed chamfered portions 29 which are inclined from the pole face 28 toward the bottom portion 26.

Coils 30 are fitted respectively on outer peripheries of the cores 27. In this embodiment, all the coils 30 are wound in the same direction, provided this constitutes no limitation. Coils 30 different in the winding direction may be arranged selectively.

The yoke 11 is held grippingly between the front case 2 and the rear case 3 in a state in which its open side opposite to the bottom portion 26 is opposed to an open, opposite end side of the rear case 3.

Plural recesses 31 are formed in an end face of the outer periphery-side cylindrical portion 24 on the side opposite to the bottom portion 26. The recesses 31 have a concave shape such that an inner periphery surface of each of the recesses is formed so as to have a radius of curvature approximately equal to that of an outer periphery surface of the arcuate portion 8*a* of each armature. The recesses 31 are provided in the same number as the number of the cores 27 so as to be each positioned on a virtual straight line joining the axis of the yoke 11 and a central part of each core 27. The arcuate portion 8*a* formed on one end side of each armature 8 is slidably fitted in each recess 31.

A to-be-fitted portion 32 as an annular member for fitting thereon of the inner periphery-side ring-shaped portion 20 of the armature spacer 12 is provided along an end face of the inner periphery-side cylindrical portion 25 on the side opposite to the bottom portion 26. A fitting structure is realized by the inner periphery-side ring-shaped portion 20 and the to-be-fitted portion 32.

The to-be-fitted portion 32 has an annular shape integral with the inner periphery-side cylindrical portion 25 so as to be positioned concentrically with the cylindrical portion 25. A stepped portion 34 is formed by the to-be-fitted portion 32 and the inner periphery-side cylindrical portion 25.

An outside diameter of the to-be-fitted portion 32 is set equal to or somewhat smaller than that of the inner periphery-side cylindrical portion 25. Particularly, in this embodiment, the outside diameter of the to-be-fitted portion 32 is set so that the difference between it and an inside diameter of the inner periphery-side ring-shaped portion 20 is not larger than 50 $\mu$m.

By suitably adjusting relative sizes between the inside diameter of the inner periphery-side ring-shaped portion 20 and the outside diameter of the to-be-fitted portion 32, the armature spacer 12 and the yoke 11 are combined to such an extent as the armature spacer 12 does not come off even when the armature spacer 12 is positioned below the yoke 11 in a combined state of the two. Besides, for maintenance of the printer 51 (see FIG. 5), the armature spacer 12 can be disassembled from the yoke 11.

The yoke 11 used in this embodiment is formed by a forming work using a magnetic material. By adopting the forming work, the yoke 11 having the to-be-fitted portion 32 can be fabricated easily and highly accurately.

Although in this embodiment the to-be-fitted portion 32 on which the inner periphery-side ring-shaped portion 20 of the armature spacer 12 is fitted from the outer periphery side is formed as an annular member, no limitation is made thereto. For example, there may be provided an annular member adapted to be fitted with the inner periphery-side ring-shaped portion of the armature spacer 12 in such a manner that the outer periphery-side face of the ring-shaped portion 20 and the inner periphery-side face of the annular member are brought into contact with each other.

No limitation is made, either, to the annular member that defines the stepped portion 34 with respect to the inner periphery-side cylindrical portion 25. A fitting structure may be realized by direct fitting of both inner periphery-side cylindrical portion 25 and inner periphery-side ring-shaped portion 20.

The following description is now provided about a printer using the impact dot print head 1 constructed as above.

Figure 5:
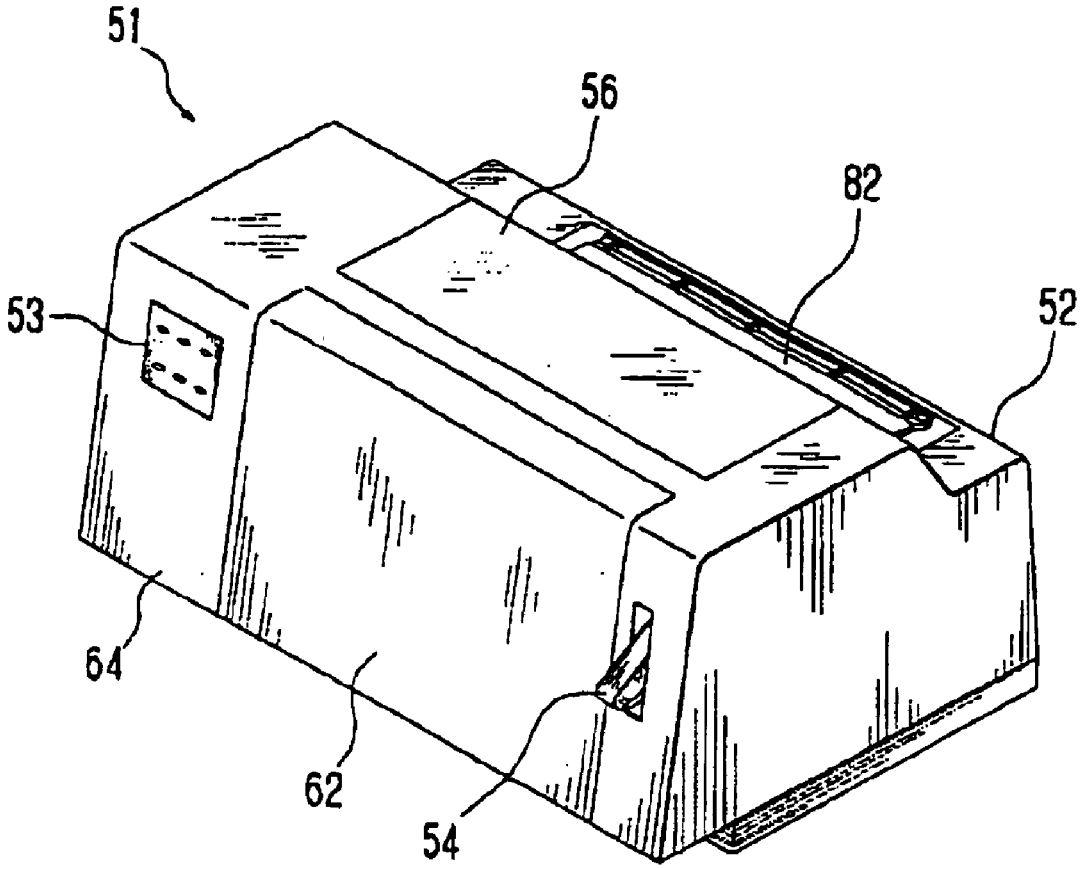
FIG. 5 is a perspective view showing a printer according to the present invention.
Figure 6:
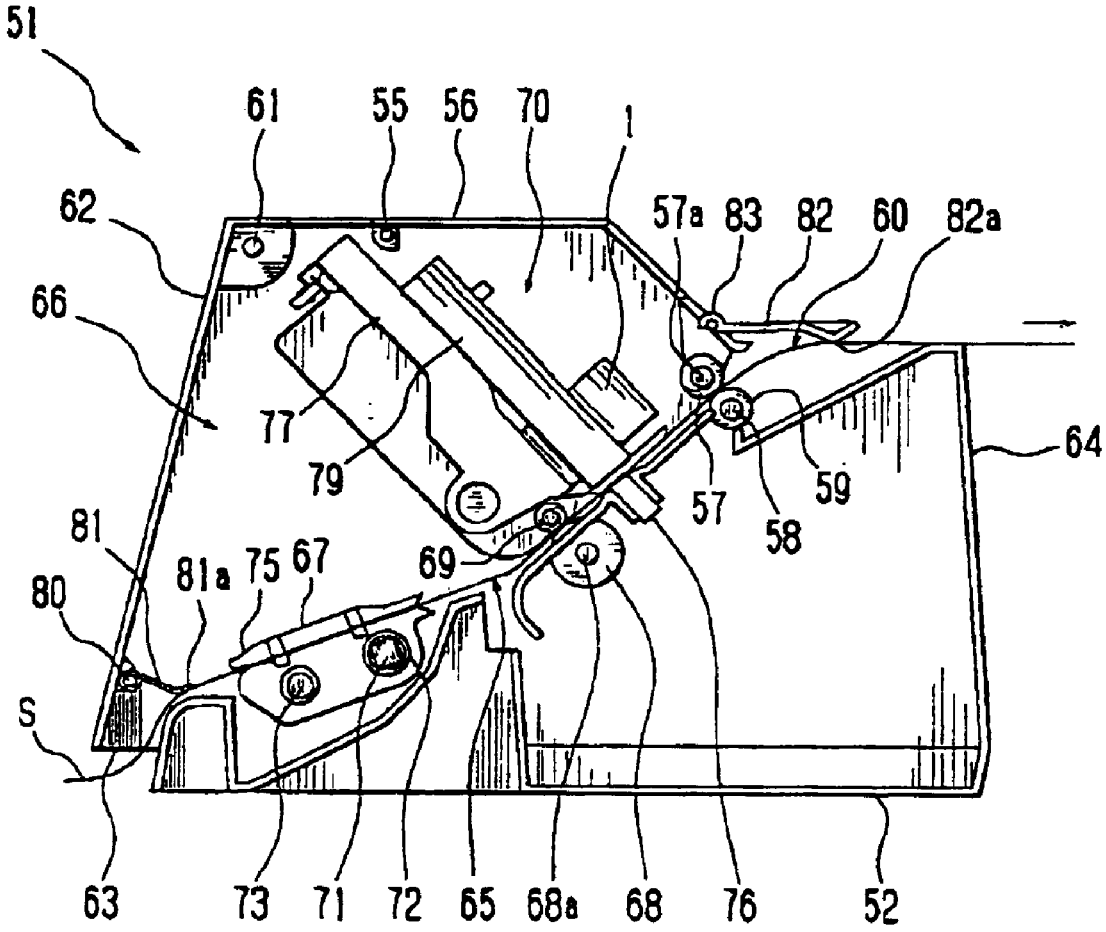
FIG. 6 is a side view in vertical section, showing an outline of the printer according to the present invention.

FIG. 5 is a perspective view of the printer and FIG. 6 is a side view in vertical section showing the printer schematically. In the printer embodying the present invention, which is indicated at 51, band-like continuous paper S is used as a recording medium, the paper S having plural holes which are formed intermittently on both sides in the transverse direction of the paper.

In a casing 52 of the printer 51 is provided an operating panel 53 having various operating keys on the front left side and a power switch 54 on the front right side.

On an upper surface side of the casing 52 is provided a ribbon change cover 56 which is pivotable in a direction (upward) away from the casing 52 about a pivot shaft 55 which is provided on an upper side of the printer 51. The ribbon change cover 56 is provided with a pinch roller 57 which is pivotable about a pivot shaft 57*a*. A feed roller 59 which is pivotable about a pivot shaft 58 is in abutment * against the pinch roller 57. In this embodiment, a downstream side of a nip portion between the pinch roller 57 and the feed roller 59 defines a paper discharge port 60.

Centrally of a front side of the casing 52 is provided a top cover 62 which is pivotable about a pivot shaft 61 in a direction (upward) away from the casing 52, the pivot shaft 61 being disposed on an upper side in the interior of the casing 52. A paper suction port 63 is defined by the casing 52 and the top cover 62 on a front lower side of the printer 51 in a closed state of the top cover 62.

In this embodiment, a housing 64 is formed by the casing 52, top cover 62 and ribbon change cover 56. Within the housing 64 is formed a paper guide passage 65 which is in communication at one end thereof with the paper suction port 63 and at an opposite end thereof with the paper discharge port 60 to guide the continuous paper S as a recording medium along a predetermined path. While the continuous paper S is guided through the paper guide passage 65, a space 66 is defined by an upper portion of the housing 64 and the paper guide passage 65. In the printer 51 of this embodiment, the continuous paper S is conveyed in the direction indicated with arrow in FIG. 6.

In the paper guide passage 65 there are provided tractors 67 for conveying the continuous paper S being guided through the paper guide passage 65 toward the paper discharge port 60 from the paper suction port 63, a feed roller 68 which is rotatable with a rotary shaft 68*a* as a rotational center, the rotary shaft 68*a* being rotated by means of a motor (not shown), a pinch roller 69 which is abutted against the feed roller 68 through the paper guide passage 65, and a printer unit 70 for printing a predetermined matter onto the continuous paper S on the paper guide passage 65. The feed rollers 59 and 68 are each rotated by means of a motor (not shown) to convey the continuous paper S which is pinched between those feed rollers and the pinch rollers 57 and 69. In this embodiment, the tractors 67 are disposed respectively at both end portions in the transverse direction of the paper guide passage 65. In this embodiment, a paper conveying mechanism is constituted by the tractors 67 and feed rollers 59 and 68.

Although a detailed description will here be omitted because of a known technique, the tractors 67 are provided with a drive roller 72 adapted to rotate about a square shaft 71 which is rotated by means of a motor (not shown), a guide member (not shown) provided movably on a guide shaft 73 parallel to the drive roller 72, and a belt (not shown) entrained on both driver roller 72 and guide member and having projections (not shown) projecting toward the outer periphery side. The tractors 67 are disposed in such a manner that the moving direction of the continuous paper S conveyed by the belt is parallel to the longitudinal direction of the paper guide passage 65.

The tractor 67 is further provided with a paper presser 75, the paper presser 75 having plural holes (not shown) in positions opposed to the projections of the belt. The paper presser 75 is disposed so as to be opposed to the belt through the continuous paper S which is guided through the paper guide passage 65. The paper presser 75 is pivotable in a direction (upward of paper in FIG. 7) away from the belt with a connection 75*a* as a fulcrum which is formed on one end side of the paper guide passage 65. The tractors 67 are provided with a spring for urging the paper presser 75 toward the belt, whereby the holes formed in the continuous paper S are prevented from coming off the projections on the belt during conveyance of the continuous paper S.

The printer unit 70 comprises a platen 76 disposed in the paper guide passage 65, a carriage 77 capable of reciprocating along the plate in directions orthogonal to the paper guide passage 65, the impact dot print head 1 described above which is mounted on the carriage 77, and an ink ribbon cartridge 79. The carriage 77 is driven by means of a motor (not shown) and is reciprocated along the platen 76. As the carriage 77 reciprocates along the platen 76, the impact dot print head 1 is reciprocated in the horizontal scanning direction. Thus, in this embodiment, a head drive mechanism is constituted by the carriage 77 and the motor.

The impact dot print head 1 is disposed so that the tip of each wire 14 is opposed to the platen 76. In the printer unit 70, plural coils 30 are energized selectively, whereby the tips of wires 14 are brought into the printing position through an ink ribbon (not shown) in the ink ribbon cartridge 79 to print a predetermined matter onto the continuous paper S.

In the interior of the housing 64 a pivot shaft 80 is provided above the paper guide passage 65 on the back side of the top cover 62, the pivot shaft 80 extending in a direction orthogonal to the paper guide passage 65. A sound insulating member 81 having a free end 81*a* not fixed on one end side is pivotably mounted at an opposite end thereof onto the pivot shaft 80.

With the top cover 62 closed, the free end 81*a* of the sound insulating member 81 is urged in a direction (downward) away from the top cover 62 by virtue of its own weight and assumes a position in which it interferes with the paper guide passage 65 from above. Therefore, while the continuous paper S is conducted through the paper guide passage 65, the free end 81*a* of the sound insulating member 81 interferes with (contacts) the continuous paper S.

A sound insulating member 82 has a free end 82*a* not fixed on one end side and an opposite end thereof is mounted on the back side of the printer 51 and in the vicinity of the pinch roller 57 pivotably through a hinge 83.

With a straight extension line passing through the center of the hinge 83 as a boundary line, if the free end 82*a* of the sound insulating member 82 is at a position deviated from the boundary line, the sound insulating member 82 is urged pivotally toward either the ribbon change cover 56 or the casing 52 by virtue of its own weight. Usually, the sound insulating member 82 is urged and hangs down toward the casing 52 with respect to the boundary line by virtue of its own weight and its free end 82*a* is positioned lower than the pivot shaft 55. The pressure which the free end 82*a* of the sound insulating member 82 applies to the continuous paper S depends on the mass of the sound insulating member 82, but it is such a degree of pressure as permits the free end 82*a* to be pushed back by the stiffness of the continuous paper S.

With the continuous paper S not discharged from the paper discharge port 60, the sound insulating member 82 lies at a position at which its pivotal motion is inhibited by its contact with a portion of the ribbon change cover 56 located below the hinge 83.

On the other hand, while the continuous paper S is being discharged from the paper discharge port 60, the free end 82*a* of the sound insulating member 82 abuts the continuous paper S while being pushed back toward the paper although the position of the free end 82*a* differs depending on the type and thickness of the continuous paper S. For example, in case of conveying continuous paper which is thicker or more stiff than the continuous paper S shown in FIG. 6, the free end 82*a* of the sound insulating member 82 assumes a position higher than that shown in FIG. 6. Conversely, in case of conveying thinner or less stiff paper than the continuous paper S shown in FIG. 6, the paper discharged from the paper discharge port 60 hangs down, so that the free end 82*a* of the sound insulating member 82 moves still downward by its own weight and assumes a lower position than that shown in FIG. 6.

The material for forming the sound insulating members 81 and 82 is not specially limited insofar as it can retain a predetermined shape.

Though not shown, the printer 51 incorporates a control unit for controlling various components installed within the housing 64, including the printer unit 70 and the motor.

When a certain coil 30 is energized through the control unit in a printing operation by the printer 51, there is formed a magnetic circuit among the core 27 on which the coil 30 is mounted, the magnetic circuit forming members 15 of the armature 8 opposed to the core 27, the pair of slant faces 21*a* opposed to the magnetic circuit forming members 15, the outer and inner periphery-side cylindrical portions 24, 25, the bottom portion 26, and again the core 27. As a result of formation of this magnetic circuit there occurs an attractive force between the to-be-attracted faces 17 of the magnetic circuit forming members 15 and the pole face 28 of the core 27. This attractive force acts to pull the magnetic circuit forming members 15 toward the pole face 28 of the core 27. With this attractive force, the armature 8 pivots about the pivot shaft 16 in a direction in which the to-be-attracted faces 17 of the magnetic circuit forming members 15 are attracted to the pole face 28 of the core 27.

In this embodiment, the position at which the to-be-attracted faces 17 of the magnetic circuit forming members 15 of each armature 8 pivotable about its pivot shaft 16 comes into abutment against the pole face 28 of the associated core 27 is assumed to be the printing position (see FIG. 1) and the position at which the to-be-attracted faces 17 move away from the pole face 28 is assumed to be a stand-by position.

As the armature 8 pivots to the printing position, the tip of the associated wire 14 projects to the recording paper side. In this embodiment, since an ink ribbon is interposed between the impact dot print head 1 and the continuous paper S, the pressure of the wire 14 is transmitted through the ink ribbon to the recording medium and the ink contained in the ink ribbon is transferred to the paper S, whereby printing is effected. A printing control means is here implemented.

Although in this embodiment the continuous paper S is used as a recording medium, no limitation is made thereto. For example, there may be used pressure-sensitive color developing recording paper (pressure-sensitive color developing paper) as the recording medium which paper develops color at a pressurized portion upon application of pressure thereto.

In case of using pressure-sensitive color developing recording paper (pressure-sensitive color developing paper) as the recording medium, a portion of the paper is pressurized with the pressure of wire 14 in the impact dot print head 1 and the pressurized portion develops color to effect printing. A printing control means is here implemented.

When the coil 30 is de-energized, the magnetic flux so far generated becomes extinct, so that the magnetic circuit also vanishes. As noted earlier, the armature 8 is urged away from the yoke 11 with an urging force of an urging member (not shown), so upon extinction of the magnetic circuit the armature pivots about the pivot shaft 16 toward the stand-by position with the urging force of the urging member. This pivotal movement is stopped at the stand-by position upon abutment of the arm 9 against the armature stopper 6.

Figure 7:
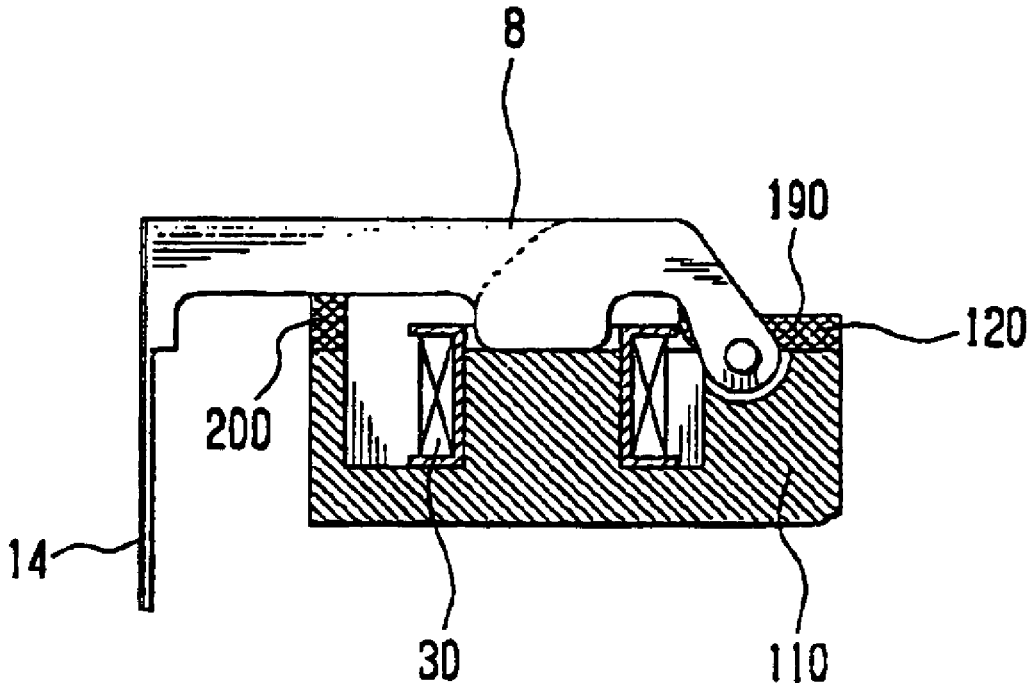
FIG. 7 is a sectional perspective view showing a section of a conventional impact dot print head.

FIG. 7 is a sectional perspective view showing a section of a conventional impact dot print head. As shown in the same figure, the conventional impact dot print head, indicated at 100, is provided with an armature spacer 120 having an outer periphery-side ring-shaped portion 190 and an inner periphery-side ring-shaped portion 200, the armature spacer 120 being in planar contact with a yoke 110 through a lower surface of the outer periphery-side ring-shaped portion 190 and a lower surface of the inner periphery-side ring-shaped portion 200. In such a conventional armature spacer 120, in order to let the inner periphery-side ring-shaped portion 200 and the yoke 110 contact each other in a satisfactory manner, the sheet metal pressing work is followed by a grinding work to maintain a satisfactory flatness of the inner periphery-side ring-shaped portion 200. However, the adoption of the grinding step after the pressing work increases the number of manufacturing steps, with consequent increase of the manufacturing cost.

The state of contact of the armature spacer 120 with the yoke 110 also depends on the relation between the outer and inner periphery-side ring-shaped portions 190, 200, and grinding must be done in such a manner that both ring-shaped portions 190 and 200 lie within the same plane. In this connection there sometimes occurs a case where a satisfactory state of contact in the whole of the armature spacer 120 cannot be ensured. In such a case, there occurs a lowering of the magnetic flux flowing efficiency between the inner periphery-side ring-shaped portion 200 whose area of contact is originally small and the yoke 110.

But in this embodiment, since the inner periphery-side ring-shaped portion 20 is fitted with the to-be-fitted portion 32 formed in the inner periphery-side cylindrical portion 25 of the yoke 11, the inner periphery-side face of the inner periphery-side ring-shaped portion 20 is pushed against the outer periphery-side face of the to-be-fitted portion 32.

Figure 8:
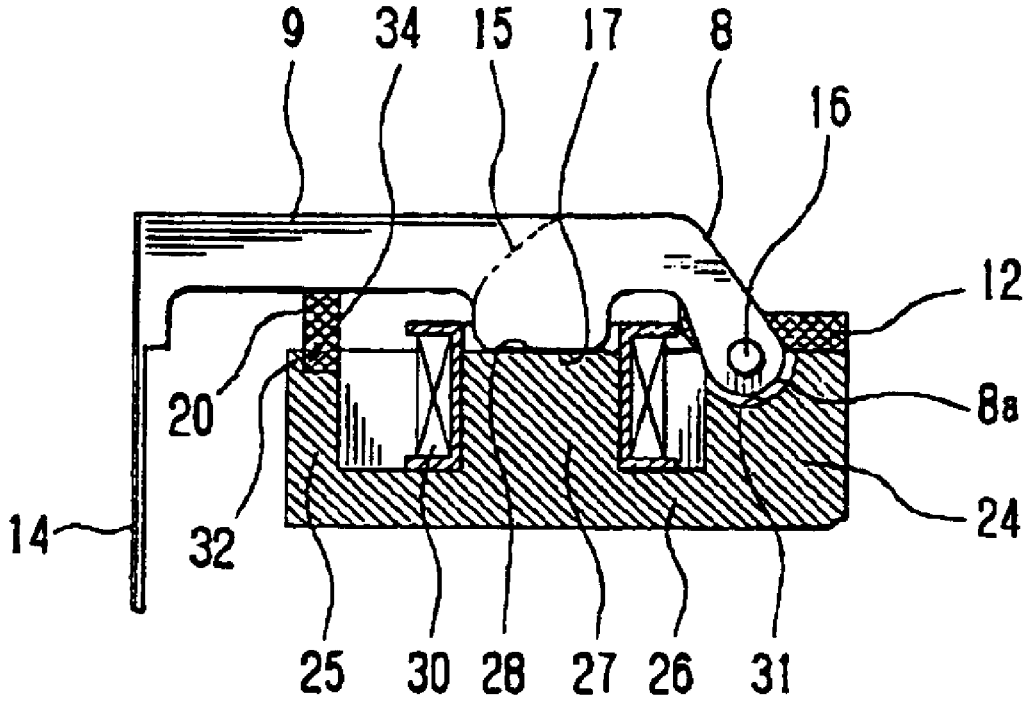
FIG. 8 is a sectional side view showing a part of the impact dot print head according to the present invention.

Consequently, as shown in FIG. 8, there can be ensured a satisfactory state of contact between the inner periphery-side face of the inner periphery-side ring-shaped portion 20 and the outer periphery-side face of the to-be-fitted portion 32, and a magnetic flux generated by each coil 30 flows through the contact face between both such inner and outer periphery-side faces of the ring-shaped portion 20 and the to-be-fitted portion 32, thus permitting the magnetic flux to flow efficiently between the two faces. As a result, it is possible to suppress the generation of a magnetic flux between the armature spacer 12 and the yoke 11 and hence possible to form a satisfactory magnetic circuit.

In the case where a lower surface of the inner periphery-side ring-shaped portion 20 and an upper end face of the inner periphery-side cylindrical portion 25 are in contact with each other, in addition to the contact between the inner periphery-side face of the inner periphery-side ring-shaped portion 20 and the outer periphery-side face of the to-be-fitted portion 32, a magnetic flux flows between the inner periphery-side ring-shaped portion 20 and the yoke 11 also through the contact face between the lower surface of the inner periphery-side ring-shaped portion 20 and the upper end face of the inner periphery-side cylindrical portion 25 in addition to the contact face between the inner periphery-side face of the inner periphery-side ring-shaped portion 20 and the outer periphery-side face of the to-be-fitted portion 32.

According to this embodiment, since the inner periphery-side face of the inner periphery-side ring-shaped portion 20 and the outer periphery-side face of the to-be-fitted portion 32 are contacted with each other and a magnetic flux is allowed to flow between the inner periphery-side ring-shaped portion 20 and the yoke 11 through the contact face, the armature spacer 12 which permits a magnetic flux to flow efficiently between the inner periphery-side ring-shaped portion 20 and the yoke 11 can be fabricated by only the pressing work. Consequently, a highly accurate armature spacer 12 can be manufactured in stable quality and hence it is possible to greatly reduce the manufacturing cost.

Figure 9A:
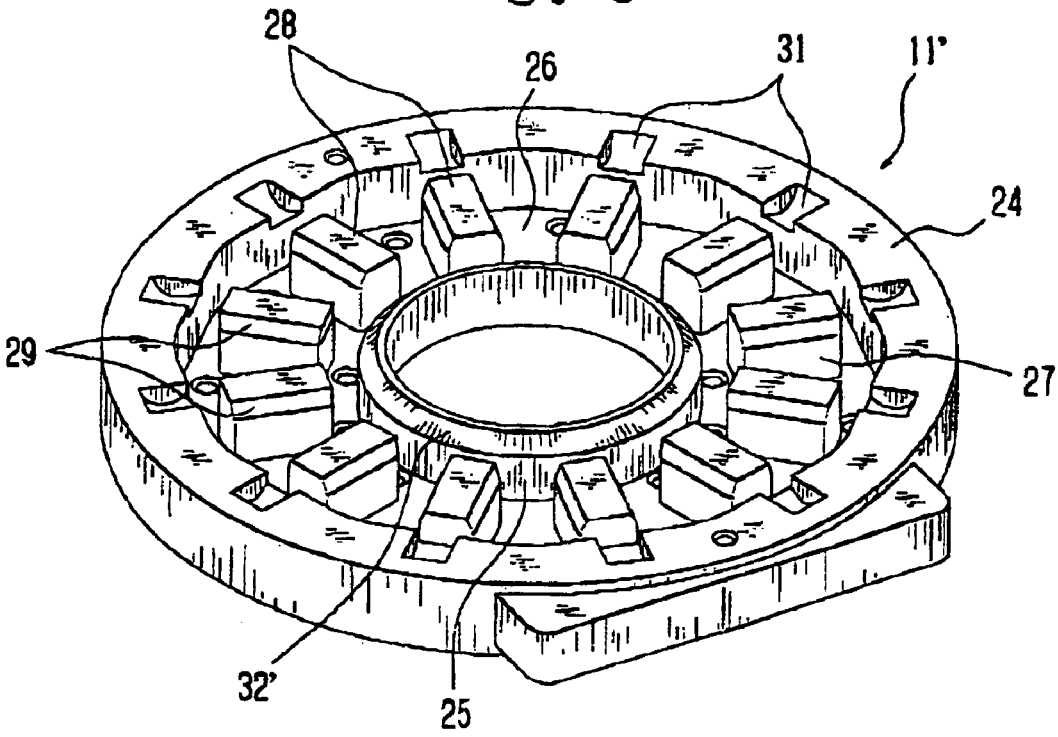
FIG. 9A is a perspective view showing a yoke according to another embodiment of the present invention.
Figure 9B:
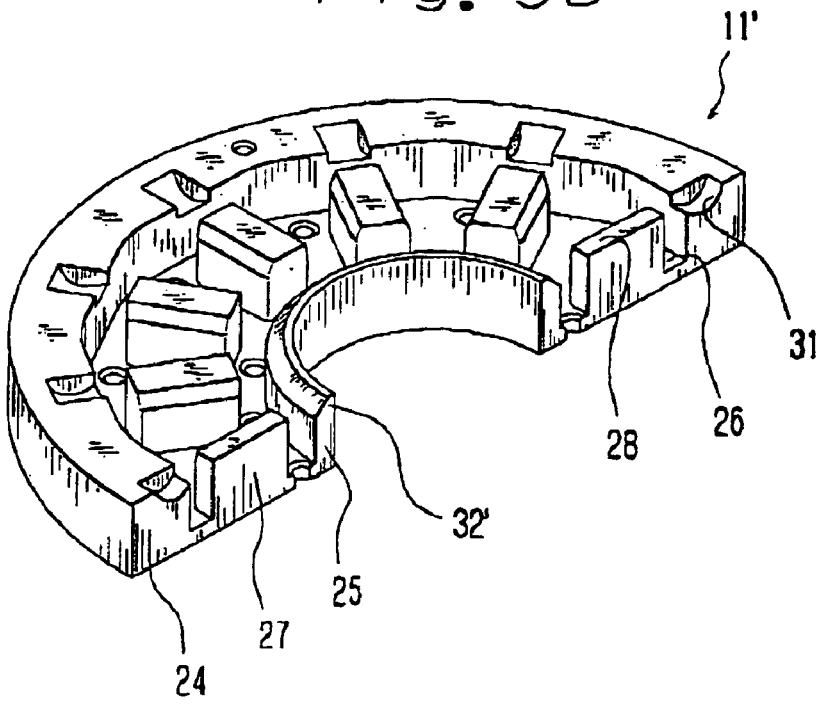
FIG. 9B is a sectional side view showing a part of the yoke according to the another embodiment of the invention.
Figure 10:
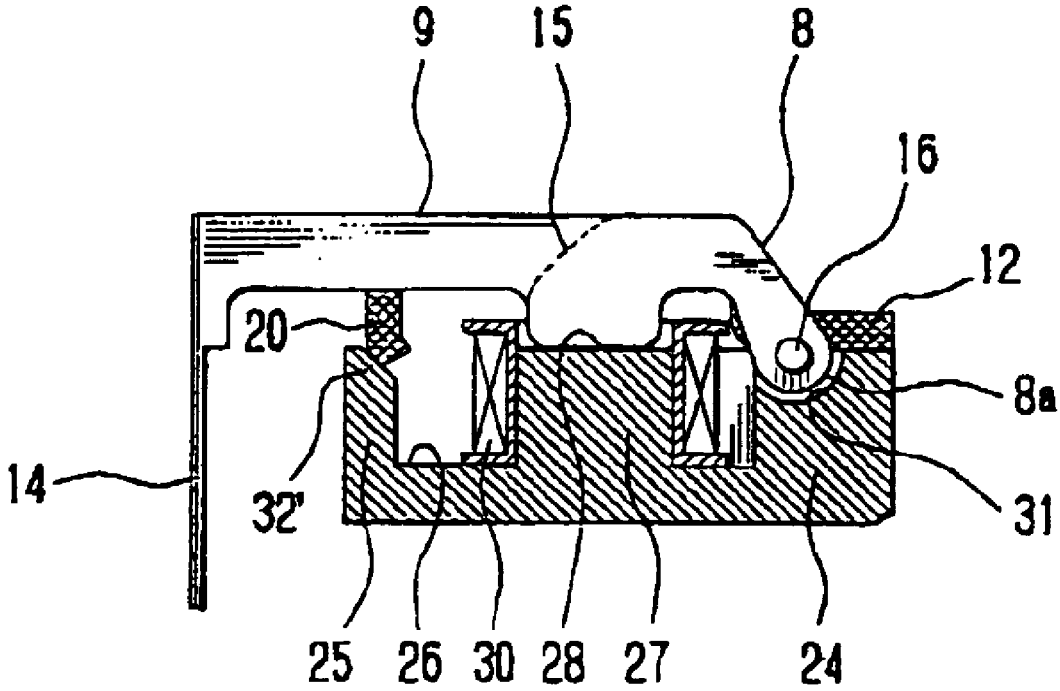
FIG. 10 is a sectional side view showing a part of an impact dot print head provided with the yoke according to the another embodiment of the invention.

Although in this embodiment there has been described the impact dot print head 1 having the yoke 11 provided with the to-be-fitted portion 32 which forms the stepped portion 34, there is made no limitation thereto. As shown in FIG. 9, another yoke 11' may be used. FIG. 9 is a perspective view showing a yoke 11' according to another embodiment and FIG. 10 is a sectional side view showing a part of an impact dot print head 1 provided with the yoke 11'. As shown in FIG. 9, a to-be-fitted portion 32' as an annular member is integral with an inner periphery-side cylindrical portion 25 of the yoke 11', the to-be-fitted portion 32' having a slant face 40 which is larger in outside diameter toward a bottom portion 26 relative to a fitting direction of both armature spacer 12 and yoke 11'.

According to the impact dot print head 1 using the yoke having the to-be-fitted portion 32', as shown in FIG. 10, the larger the depth of fitting of an inner periphery-side ring-shaped portion 20 relative to the to-be-fitted portion 32', the more strongly the inner periphery-side face of the inner periphery-side ring-shaped portion 20 is pushed against the outer periphery-side face of the to-be-fitted portion 32'.

Consequently, a magnetic flux generated by a coil 30 can be allowed to flow efficiently through the contact face between the inner periphery-side face of the inner periphery-side ring-shaped portion 20 and the outer periphery-side face of the to-be-fitted portion 32 and it is possible to surely diminish the generation of leakage flux between the armature spacer 12 and the yoke 11' and hence possible to form a satisfactory magnetic circuit.

Although in FIG. 9 there is used as the annular member the to-be-fitted portion 32' having the slant face 40 which is larger in outside diameter toward the bottom portion 26 relative to the fitting direction of both armature spacer 12 and the yoke 11', this constitutes no limitation. For example, in case of fitting the armature spacer and the yoke in such a manner that the outer periphery-side face of the inner periphery-side ring-shaped portion 20 in the armature spacer 12 and the inner periphery-side face of an annular member itself, there may be used an annular member (not shown) having a slant face which is inclined on its inner periphery side relative to the fitting direction of both armature spacer 12 and the yoke 11'.

Obviously, in view of the above description, many modifications and changes of the present invention may be made. Accordingly, it is understood that within the scope of appended claims the present invention may be practiced in different from those described above concretely.

What is claimed is:

1. An impact dot print head comprising:

a plurality of armatures each disposed so as to be pivotable between a printing position and a stand-by position;

printing wires provided so as to move with pivotal motions of the armatures;

a yoke integrally provided with a pair of concentric, cylindrical portions of different diameters and cores with coils wound thereon respectively, the cores being arranged concentrically between the cylindrical portions correspondingly to the armatures;

an armature spacer having a pair of concentric ring-shaped portions of different diameters almost equal to those of the pair of cylindrical portions respectively and also having a plurality of guide portions which span between the pair of ring-shaped portions so as to be each positioned between adjacent said armatures; and a fitting structure for fitting the cylindrical portion located on an inner periphery side of the yoke and the ring-shaped portion located on an inner periphery side of the armature spacer with each other.

2. An impact dot print head according to claim 1, wherein the fitting structure comprises an annular member and the ring-shaped portion located on an inner periphery side of the armature spacer, the annular member being integral with the cylindrical portion located on an inner periphery side of the yoke on the side opposed to the armature spacer and having a diameter different from that of the inner periphery-side cylindrical portion depending on the inner periphery-side ring-shaped portion.

3. An impact dot print head according to claim 2, wherein the annular member has an outside diameter and an inside diameter both different from at least one of an outside diameter and an inside diameter of the inner periphery-side cylindrical portion, and a stepped portion is formed on the inner periphery-side cylindrical portion on the side opposed to the armature spacer.

4. An impact dot print head according to claim 3, wherein the diameter of the annular member on the side where the annular member is fitted with the inner periphery-side ring-shaped portion is set so as to form a gap of not larger than 50 $\mu$m between it and the diameter of the inner periphery-side ring-shaped portion.

5. An impact dot print head according to claim 2, wherein the annular member has a fitting face for fitting with the inner periphery-side ring-shaped portion, the fitting face having a slant face which is inclined relative to the fitting direction.

6. A printer comprising:

an impact dot print head including:

a plurality of armatures each disposed so as to be pivotable between a printing position and a stand-by position;

printing wires provided so as to move with pivotal motions of the armatures;

a yoke integrally provided with a pair of concentric, cylindrical portions of different diameters and cores with coils wound thereon respectively, the cores being arranged concentrically between the cylindrical portions correspondingly to the armatures;

an armature spacer having a pair of concentric ring-shaped portions of different diameters almost equal to those of the pair of cylindrical portions respectively and also having a plurality of guide portions which span between the pair of ring-shaped portions so as to be each positioned between adjacent said armatures; and a fitting structure for fitting the cylindrical portion located on an inner periphery side of the yoke and the ring-shaped portion located on an inner periphery side of the armature spacer with each other;

a head drive mechanism for reciprocating the impact dot print head in a horizontal scanning direction;

a printing control means which in accordance with printing data causes the impact dot print head to be reciprocated by the head drive mechanism and which causes the armatures in the impact dot print head to pivot selectively; and a recording medium conveying mechanism which brings a recording medium into opposition to the impact dot print head in the reciprocative range of the impact dot print head and which conveys the recording medium in a vertical scanning direction orthogonal to the horizontal scanning direction in accordance with a printing control made by the printing control means.

7. A printer according to claim 6, wherein the fitting structure in the impact dot print head comprises an annular member and the ring-shaped portion located on an inner periphery side of the armature spacer, the annular member being integral with the cylindrical portion located on an inner periphery side of the yoke on the side opposed to the armature spacer and having a diameter different from that of the inner periphery-side cylindrical portion depending on the inner periphery-side ring-shaped portion.

8. A printer according to claim 7, wherein the annular member has an outside diameter and an inside diameter both different from at least one of an outside diameter and an inside diameter of the inner periphery-side cylindrical portion, and a stepped portion is formed on the inner periphery-side cylindrical portion on the side opposed to the armature spacer.

9. A printer according to claim 8, wherein the diameter of the annular member on the side where the annular member is fitted with the inner periphery-side ring-shaped portion is set so as to form a gap of not larger than 50 $\mu$m between it and the diameter of the inner periphery-side ring-shaped portion.

10. A printer according to claim 7, wherein the annular member has a fitting face for fitting with the inner periphery-side ring-shaped portion, the fitting face having a slant face which is inclined relative to the fitting direction.

* * * * *